United States Patent [19]

Falcone et al.

[11] Patent Number: 4,583,737

[45] Date of Patent: Apr. 22, 1986

[54] FORTUNE TELLING GAME AND DECK OF CARDS

[76] Inventors: Mary L. Falcone, 155 W. 68th St., New York, N.Y. 10023; Nicholas T. Zann, 210 E. 29th St., New York, N.Y. 10016

[21] Appl. No.: 616,973

[22] Filed: Jun. 4, 1984

[51] Int. Cl.[4] ..... A63F 1/04; A63F 9/18

[52] U.S. Cl. ..... 273/161; 273/292

[58] Field of Search ..... 273/161, 292

[56] References Cited

U.S. PATENT DOCUMENTS

| | | | |
|---|---|---|---|
| D. 269,921 | 8/1983 | Young, Jr. | 273/161 X |
| 2,034,991 | 3/1936 | Salinger | 273/161 |
| 3,749,406 | 7/1973 | Bowart | 273/161 |
| 3,801,106 | 4/1974 | Milton | 273/161 |
| 3,970,315 | 7/1976 | Redner | 273/161 |
| 4,014,551 | 3/1977 | Alfonso | 273/161 |

OTHER PUBLICATIONS

"The Tarot", by Brian Innes, publ. by Arco Publishing Co., N.Y., copyright 1977, pp. 74–85.

Numerology: Key to the Tarot, by Sandor Konraad (1983), pp. 12, 15 and 17.

*Primary Examiner*—Anton O. Oechsle

*Attorney, Agent, or Firm*—Frishauf, Holtz, Goodman & Woodward

[57] ABSTRACT

A deck of fortune telling cards for indicating a response to a query comprising: a plurality of cards, each of said cards having a top and bottom end and a single indicia bearing face, the indicia of said indicia bearing face being oriented in a common direction from said top end to said bottom end, said indicia of each card comprising at least one word, symbol or combination thereof which bears a first suggestive relationship to said query when the card is oriented with the top end above the bottom end, and an opposite suggestive relationship to said query when said card is oriented with the top end below the bottom end; said plurality of cards comprising a first group of cards, each bearing indicia suggestive of a composite of at least one of a physical and personality characteristic of a person; and a second group of cards, each bearing indicia suggestive of a relationship to the query or a relationship to the indicia of each of said first group of cards or both. Also disclosed are methods of playing the fortune telling game and playing boards used in conjunction therewith.

31 Claims, 3 Drawing Figures

FORTUNE TELLING GAME AND DECK OF CARDS

FIELD OF THE INVENTION

The present invention is directed to a fortune telling game which through the intuitive and interpretive input of the player, can be used to attain personal answers to simple and complex questions pertaining specifically to the player, another party or to the relationship between two or more people. The invention includes a deck of fortune telling cards alone or in combination with a game board apparatus and also methods of playing the game.

BACKGROUND OF THE INVENTION

Much has been written about the relationship between numbers and their interpretive application to the myriad of thought provoking questions that arise during a person's life. The study of the significance of numbers is known as numerology and its devotees have studied the influence of numbers on religion and other thought provoking subjects such as, Tarot and astrology, as more fully described in *Numerology: Key to the Tarot,* by Sandor Konraad (1983) incorporated herein by reference.

The fortune telling game of the present invention is based on the interpretive significance of patterns of numbers which are used to dictate the manner in which indicia bearing cards are selected and interpreted with respect to the query posed by the player at the beginning of the game.

It is therefore an object of the invention to provide a fortune telling game for amusement which employs a deck of fortune telling cards wherein the game is played by interpreting the relationship of the cards to a query posed by the player when the cards are selected in prescribed patterns.

SUMMARY OF THE INVENTION

The invention includes a deck of fortune telling cards comprising a first group of cards suggestive of the physical and/or the personality characteristics of a person and a second group of cards suggestive of a relationship to the first group of cards and/or a relationship to the query posed by the player to determine an answer to the query. The invention includes a game board apparatus and fortune telling games which can be played using the deck of fortune telling cards.

DETAILED DESCRIPTION

Figure 3:
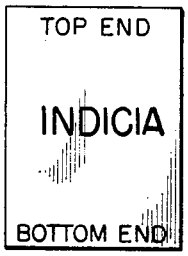
FIG. 3 schematically illustrates a typical playing card.

The present invention includes a deck of fortune telling cards used for arriving at a response to a query posed by the player at the beginning of the fortune telling game. The deck of cards is made up of a plurality of cards, each of which has a top and bottom end and a single indicia bearing face. See FIG. 3 which schematically shows the general format of each card. The opposite face may, for example, have decorative work thereon. The indicia of the indicia bearing face is oriented in a common direction from the top end to the bottom end of the card. The indicia may be at least one word, symbol or combination thereof which bears a suggestive relationship to the query posed by the player. The suggestive relationship is personal to the player and may be interpreted in different ways by different players. Since the indicia of the indicia bearing face is oriented in a common direction from the top end to the bottom end of the card, when the card is arranged so that the top end is above the bottom end (i.e., in the rightside up position) the word, symbol or combination thereof on the card bears a first suggestive relationship to the query. If the card is arranged so that the top of the card is below the bottom end of the card (i.e., the card is in the upside down position) then the indicia is interpreted in the opposite manner from the way it would be interpreted if the card was in the rightside up position.

The cards are divided into two groups. Each card of the first group bears indicia suggestive of a composite of at least one of the physical and/or personality characteristics of a person. For example, one card of the first group of cards shows by word, symbol or combination thereof a composite of characteristics which suggest power, wealth, stability, achievement, reasons with his head not his heart, capable of using his authority with confidence and a father figure. In accordance with the fortune telling game of the invention, if the indicia bearing face of this card is revealed in the rightside up position, the card suggests that the person has the characteristics of power, wealth, stability, achievement, reasons with his head not his heart, capable of using his authority with confidence and is a father figure. On the other hand, if the card is revealed in the upside down position, the opposite interpretive significance is applied to the card as, for example, a person who is immature, has clay feet and is chauvinistic.

Each of the cards of the second group of cards bear indicia suggestive of a relationship to the query and/or a relationship to the indicia of each of the first group of cards, depending on the interpretation made by the player. Examples of the indicia on the cards of the second group of cards include anxiety, challenge, change, clarity, etc. The second group of cards by and through the indicia on the indicia bearing face of the same are used to arrive at a response to the query posed by the player or, in another method of the invention, used to interpret the relationship between two or more people represented by the first set of cards.

In a preferred form of the invention, twelve cards comprise the first group of cards. By word, symbol or combination thereof the cards are suggestive of the following characteristics of a person: brown haired man, brown haired woman, dark haired man, dark haired woman, fair/gray haired man, fair/gray haired woman, the fool, the lady, the master, the stranger, the troubleshooter, and the woman of the world. The first six of the above-mentioned first group of cards are self-explanatory. The following is a list of the composite characteristics making up each of the last six members of the first group of cards.

THE FOOL: naive, jumping into each new adventure without a moment's thought, extravagant, obsessive and thoughtless.

The opposite: indecisive, lethargic, no follow-through, timid, ignorant of opportunities.

WOMAN OF THE WORLD: intellectual, self-reliant, wisdom, objective, serene, wise in the ways of the world.

The opposite: selfish, cold, shallow, superficial knowledge.

THE MASTER: power, wealth, stability, achiever, reasons with his head not his heart, capable of using his authority with competence, father figure.

The opposite: immature, clay feet, chauvinistic.

THE LADY: feminine, fertile, the epitome of woman, mother, sister, wife, practical, intuitive, she makes use of her sixth sense.

The opposite: lethargic, vain, fickle in love, indecisive, infidelity, barren, loss of material possessions.

THE TROUBLE-SHOOTER: nimble, imaginative and skillful, ingenious, master of self-control, capable of handling any task, can be sly, crafty and deceptive, agile, a formidable opponent, influential, talented.

The opposite: dirty tricks, weak and inept, the use of his skills and craft to evoke destructive ends.

In the above list, the first set of characteristics are applicable when the particular card is exposed during the playing of the game in the rightside up position. The opposite characteristics are applied when the card is exposed in the upside down position.

The second group of cards may include any number of cards, each of which bears indicia suggestive of a relationship to the query or to the indicia of the first group of cards or to both. Examples of the indicia for the second group of cards are as follows:

1. Abundance
2. Anxiety
3. Bad News
4. Barrier
5. Battle
6. Challenge
7. Change
8. Clarity
9. Communication
10. Confusion
11. Deception
12. Destruction
13. Diligence
14. Doubt
15. Ending
16. Faith
17. Fame
18. Forgiveness
19. Friend
20. Frustration
21. Gain
22. Generosity
23. Good Fortune
24. Good News
25. Greed
26. Growth
27. Happiness
28. Heartbreak
29. Hidden Enemy
30. Home
31. Hope
32. Inspiration
33. Jealousy
34. Journey
35. Judgement
36. Justice
37. Loss
38. Love
39. Mistake
40. New Beginnings
41. Patience
42. Peace
43. Power
44. Reconciliation
45. Scandal
46. Secrets
47. Sexual Attraction
48. Solitude
49. Spiritual
50. Stop! Look! Listen!
51. Storm
52. Strength
53. Surprise
54. Talent
55. The Lovers
56. The Lesson
57. Truth
58. Victory
59. Vulnerable
60. Wealth
61. Wisdom Other indicia bearing cards of the second group may be used within the spirit of the present invention.

The fortune telling game of the present invention may be played in two distinct ways. In the first method, the object of the game is to obtain an answer to a query posed by the player at the outset of the game. The cards are manipulated as more fully described below in a manner which is interpretive of the past, present and future status of the question followed by an answer to the query. Any question may be asked but it is preferable to ask a question which requires a complex answer. For example, it is preferable not to ask a question to which there is a yes or no answer. It is also preferable not to ask the question over and over to facilitate a more "spontaneous" response or interpretation of the cards.

The game begins by the player posing a query. The deck of cards is then shuffled with the indicia bearing faces of the cards facing downward and out of view of the player. Lateral shuffling, as opposed to "gambler's shuffling" (end to end) can be used to prevent inadvertent turning of the indicia bearing faces of the cards. The cards are cut, after shuffling, preferably with the left hand (controlled by creative right side of the brain). Preferably, the shuffling of the deck takes place after the posing of the question. It is preferred that the question be recited aloud so that the player and any observers that are present are clear as to what the question is when the answer is obtained at the end of the game.

Figure 1:
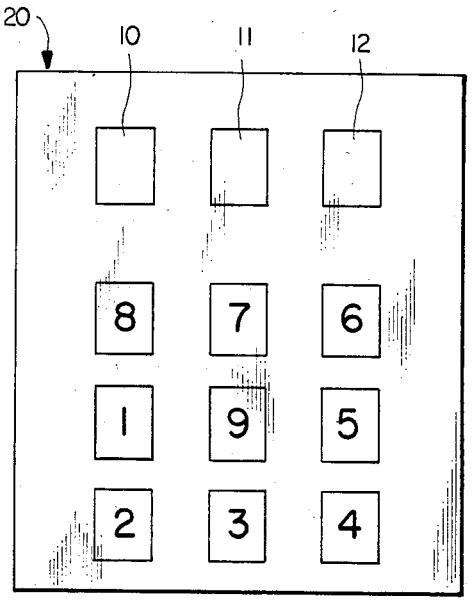
FIG. 1 illustrates a playing board for playing the game of the invention.

After shuffling, the deck of cards is preferably divided into 3 piles which are placed over boxes 10–12, respectively, on a surface, such as the surface of playing board 20 shown in FIG. 1, with the indicia bearing face of each card facing downward toward the surface and out of view of the player. Optionally, but not preferred, the deck may be used as a single pile, or divided into any number of piles placed on the surface so long as each card of each pile has the indicia bearing face facing downward as described above.

The player then sequentially selects nine cards from the single pile or any number of the plurality of piles while keeping the indicia bearing face facing downward and out of view of the player. The nine cards selected are sequentially placed in a preselected pattern (boxes 1–9) on the surface of FIG. 1 while keeping the indicia bearing face out of view of the player. In the preselected pattern shown in FIG. 1, box 1 is the position on which the first selected card is placed on the surface. The second selected card is then placed on box 2 and so forth until all nine cards are placed in the preselected pattern. The nine selected cards are then sequentially turned over by the player in the order box 1 to box 9 to expose the indicia bearing face of each card. The cards are turned over from right to left similar in way to which a person would turn the page of a book. Hereinafter, the cards over boxes 1–9 are referred to as cards 1–9, respectively.

More specifically, the first card in the preselected pattern is turned over as described above. If the card is turned over in the rightside up position, the player interprets the card based on what the indicia of the exposed indicia bearing face suggests to him or her. On the other hand, if the card is exposed in the upside down position, the player interprets the indicia opposite to what the interpretation would be if the card were in the rightside up position.

After each card is thus exposed, the player interprets the relationship of the indicia on each exposed card to the query with the proviso that cards 1 and 2 are interpretive of the past as regards the query, cards 3 and 4 are interpretive of the present as regards the query, cards 5–8 are interpretive of the future as regards the query, the card 9 is used as the basis for the answer to the query. The cards may be interpreted alone as they relate to the query or may be interpreted with respect to each other and still be within the spirit of the invention.

The second method of playing the game is used to determine the relationship between two or more people. The player or players pose a query concerning the relationship between the two or more people. Preferably the query is not answerable by a yes or no. The query is posed and the deck is shuffled in the same manner as with the previously mentioned game.

In playing the game so as to determine the relationship between two people, the player selects two cards from the deck of cards which fall within the first group of cards as described previously. The two cards are selected which most closely resemble the characteristics of the two respective persons which are the subject of the query. The player of the game can, of course, look through the deck of cards with the indicia bearing face facing toward the player in order to select the two cards of the first group of cards. The deck may then be reshuffled with the indicia bearing face facing out of view of the player.

Figure 2:
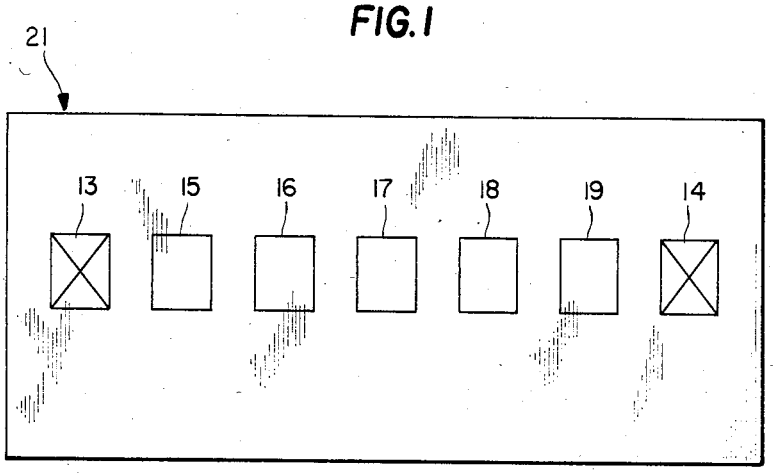
FIG. 2 illustrates another playing board for playing a modified game of the invention.

Referring to FIG. 2, the two selected cards are placed on the playing surface 21 in boxes 13,14 with the indicia bearing face exposed to the player. The cards are placed in spaced apart relationship from each other wherein the space between the two cards is sufficient to insert five cards which are placed in boxes 15–19, respectively. A different number than five could be placed between the two end cards, but five is preferred and the following description is given for five cards being placed between the end cards.

The deck of cards with all cards contained in the deck having the indicia bearing face being unexposed to the player is then used to continue the game. A preselected number of cards are taken from the top of the deck and discarded. The next card on the top of the deck is placed with the indicia bearing face facing downward in box 15 adjacent the first exposed card in box 13 from the first group of cards. In a preferred form of the invention, the player discards six cards from the top of the deck and selects the seventh card for placing in box 15.

The above procedure is repeated until the selected number of cards are placed in the facedown position in boxes 16–19, respectively between the two exposed cards in boxes 13,14, respectively. It is preferred to select five cards from the deck so that the two exposed cards are separated by five cards in the facedown position which are selected in the manner described above.

The unexposed card in box 15 adjacent to the exposed card from the first group of cards in box 13 is then turned over from right to left to expose the indicia bearing face thereof and then the indicia of the exposed indicia bearing face is interpreted depending on whether the card is in the rightside up or upside down position. The thus exposed card in box 15 is interpreted as it relates to the relationship between the two previously exposed cards in boxes 13,14, respectively selected from the first group of cards. This procedure is repeated until each of the cards in boxes 16–19, respectively is interpreted with respect to the query posed concerning the relationship between the two people which are represented by the exposed cards in boxes 13,14 of the first group of cards.

The aforementioned fortune telling games can be played using the deck of cards described previously and fortune telling boards as shown in FIGS. 1 and 2. The boards shown in FIGS. 1 and 2 can be combined to form a composite game board for playing either or both games. Alternatively, the games can be played on any surface without a board. If no board is used, the player(s) either remember where to place the cards or use a diagram which indicates card placement.

What is claimed is:

1. A fortune telling game comprising: a deck of fortune telling cards comprising:

a plurality of cards, each of said cards having a top and bottom end and a single indicia bearing face, the indicia of said indicia bearing face being oriented in a common direction from said top end to said bottom end, said indicia of each card comprising at least one word, symbol or combination thereof which bears a first suggestive relationship to a query when the card is oriented with the top end above the bottom end, and an opposite suggestive relationship to said query when said card is oriented with the top end below the bottom end;

said plurality of cards comprising a first group of cards, each bearing indicia suggestive of a composite of at least one of a physical and personality characteristic of a person; and said plurality of cards further comprising a second group of cards, each bearing indicia suggestive of a relationship to the query or a relationship to the indicia of each of said first group of cards or both; and a game board comprising card receiving stations for receiving said cards on said game board, said card receiving stations consisting of:

a first card receiving station consisting of three card receiving spaces arranged in a row; and a second card receiving station consisting of nine card receiving spaces arranged in three parallel rows which are parallel with said row of said first card receiving station, each of said parallel rows of said second card receiving station consisting of three adjacent card receiving spaces.

2. A method of playing a fortune telling card game comprising:

(a) posing a query;

(b) shuffling a deck of fortune telling cards, said deck of fortune telling cards comprising:

a plurality of cards, each of said cards having a top and bottom end and a single indicia bearing face, the indicia of said indicia bearing face being oriented in a common direction from said top end to said bottom end, said indicia of each card comprising at least one word, symbol or combination thereof which bears a first suggestive relationship to said query when the card is oriented with the top end above the bottom end, and an opposite suggestive relationship to said query when said card is oriented with the top end below the bottom end;

said plurality of cards comprising a first group of cards, each bearing indicia suggestive of at least one of a physical and personality characteristic of a person; and a second group of cards, each bearing indicia suggestive of a relationship to the query or a relationship to the indicia of each of said first group of cards or both, wherein the indicia bearing face of each card of said deck of fortune telling cards faces away from and out of view of the player of the game during said shuffling step;

(c) cutting the deck of shuffled cards;

(d) placing the cut deck of cards on a surface in at least one pile of cards with the indicia bearing face of each card facing said surface and out of view of said player;

(e) selecting a first card from the top of the at least one pile of cards and placing said first selected card with the indicia bearing face facing downward toward said surface and out of view of said player onto a first card receiving space on said surface in accordance with the following sequence:

| 8 | 7 | 6 |
|---|---|---|
| 1 | 9 | 5 |
| 2 | 3 | 4 |

(f) repeating said step (e) until second through ninth selected cards are placed onto the corresponding second through ninth card receiving spaces on said surface;

(g) exposing the indicia bearing face of said first through ninth cards;

(h) determining whether said exposed cards bear said first or said opposite suggestive relationship to said query; and (i) interpreting the relationship of said exposed cards to said query wherein first and second exposed cards are suggestive of the past status of the query, said third and fourth exposed cards are suggestive of the present status of the query, said fifth through eighth exposed cards are suggestive of the future status of the query and said ninth exposed card is suggestive of the outcome of the answer to the query.

3. The method of claim 2 further comprising dividing the cut deck into three piles whereby each pile has a top card, and wherein said steps (e) and (f) comprise selecting said first card from the top of any of said three piles and placing said selected first card onto the first card receiving space on said surface and repeating the steps of selecting and placing the top card from any of said piles until said selected cards are placed onto each of the nine corresponding card receiving spaces on said surface.

4. The method of claim 3, wherein said indicia bearing faces of said first to ninth cards are exposed sequentially.

5. The method of claim 4, wherein the deck of shuffled cards is cut with the left hand; and said exposing step (g) comprises turning said cards over from right to left like turning pages of a book.

6. The method of claim 2, wherein the deck of shuffled cards is cut with the left hand.

7. The method of claim 2, wherein said indicia bearing faces of said first to ninth cards are exposed sequentially.

8. The method of claim 2, wherein said exposing step (g) comprises turning said cards over from right to left like turning pages of a book.

9. A method of playing a fortune telling card game using a deck of fortune telling cards comprising a plurality of cards, each of said cards having a top and bottom end and a single indicia bearing face, the indicia of said indicia bearing face being oriented in a common direction from said top end to said bottom end, said indicia of each card comprising at least one word, symbol or combination thereof which bears a first suggestive relationship to a query when the card is oriented with the top end above the bottom end, and an opposite suggestive relationship to said query when said card is oriented with the top end below the bottom end; said plurality of cards comprising a first group of cards, each bearing indicia suggestive of at least one of a physical and personality characteristic of a person; and a second group of cards, each bearing indicia suggestive of a relationship to the query or a relationship to the indicia of each of said first group of cards or both, wherein the indicia bearing face of each card of said deck of fortune telling cards faces away from and out of view of the player of the game during a shuffling step, the method comprising (a) posing a query concerning the relationship between a first and second person;

(b) selecting two cards from said first group of cards of said deck of cards, said first card bearing a suggestive relationship to said first person and said second card bearing a suggestive relationship to said second person;

(c) shuffling the deck of fortune telling cards;

(d) placing said first and second cards in spaced-apart relationship from each other on a surface with the indicia bearing face of each card being exposed, wherein the space between said first and second card defines at least one unoccupied card receiving space;

(e) discarding a preselected number of cards from the top of said deck of cards, each card of said deck of cards having said indicia bearing face facing downward toward said surface to thereby reveal a top card of said deck of cards;

(f) removing the top card from said deck of cards after discarding a preselected number of cards and then placing said removed top card in an unoccupied card receiving space closest to said first card to form an occupied card receiving space;

(g) repeating steps (e) and (f) until each unoccupied card receiving space is converted to an occupied card receiving space containing a top card from said deck of cards;

(h) exposing the indicia bearing face of said top card in said occupied card receiving space;

(i) determining whether said exposed top card bears said first or said opposite suggestive relationship to said query;

(j) interpreting the relationship of each of said exposed top cards to said first and second card to thereby obtain an answer to said query.

10. The method of claim 9, wherein said preselected number in step (e) is six.

11. The method of claim 10, wherein the number of said unoccupied card receiving spaces is five.

12. The method of claim 11, wherein said exposing step (h) comprises turning said cards over from right to left like turning pages of a book.

13. The method of claim 9, wherein the number of said unoccupied card receiving spaces is five.

14. The method of claim 9, wherein said exposing step (h) comprises turning said cards over from right to left like turning pages of a book.

15. The method of claim 9, further comprising cutting said deck of cards after said shuffling step (c).

16. The method of claim 15, wherein said cutting step comprises cutting the deck of shuffled cards with the left hand.

17. A fortune telling game comprising: a deck of fortune telling cards comprising:

a plurality of cards, each of said cards having a top and bottom end and a single indicia bearing face, the indicia of said indicia bearing face being oriented in a common direction from said top end to said bottom end, said indicia of each card comprising at least one word, symbol or combination thereof which bears a first suggestive relationship to a query when the card is oriented with the top end above the bottom end, and an opposite suggestive relationship to said query when said card is oriented with the top end below the bottom end;

said plurality of cards comprising a first group of cards, each bearing indicia suggestive of a composite of at least one of a physical and personality characteristic of a person; and said plurality of cards further comprising a second group of cards, each bearing indicia suggestive of a relationship to the query or a relationship to the indicia of each of said first group of cards or both; and a game board comprising card receiving stations for receiving said cards on said game board, said card receiving stations consisting of a first card receiving station consisting of two spaced apart card receiving spaces; and a second card receiving station consisting of five card receiving spaces arranged in a single row between said spaced apart card receiving spaces of said first card receiving station; said card receiving spaces of said first and second card receiving stations being arranged in said single row.

18. A method of playing a fortune telling card game comprising:

(a) posing a query;

(b) preparing a deck of fortune telling cards, said deck of fortune telling cards comprising:

a plurality of cards, each of said cards having a top and bottom end and an indicia bearing face, the indicia of said indicia bearing face being oriented in a given direction from said top end to said bottom end, said indicia of each card comprising at least one word, symbol or combination thereof which bears a first suggestive relationship to said query when the card is oriented with the top end above the bottom end, and a second suggestive relationship to said query when said card is oriented with the top end below the bottom end;

said plurality of cards comprising a first group of cards, each bearing indicia suggestive of a personal characteristic; and a second group of cards, each bearing indicia suggestive of a relationship to the query or a relationship to the indicia of each of said first group of cards or both, wherein the indicia bearing face of each card of said deck of fortune telling cards faces away from and out of view of the player of the game during said preparing step;

(c) placing the deck of cards on a surface in at least one pile of cards with the indicia bearing face of each card facing said surface and out of view of said player;

(d) selecting a first card from the top of the at least one pile of cards and placing said first selected card with the indicia bearing face facing downward toward said surface and out of view of said player onto a first card receiving space on said surface in accordance with the following sequence:

| | | |
|---|---|---|
| 8 | 7 | 6 |
| 1 | 9 | 5 |
| 2 | 3 | 4 |

(e) repeating said step (d) until second through ninth selected cards are placed onto the corresponding second through ninth card receiving spaces on said surface;

(f) exposing the indicia bearing face of said first through ninth cards;

(g) determining whether said exposed cards bear said first or said second suggestive relationship to said query; and (h) interpreting the relationship of said exposed cards to said query wherein first and second exposed cards are suggestive of the past status of said query, said third and fourth exposed cards are suggestive of the present status of said query, said fifth through eighth exposed cards are suggestive of the future status of said query and said ninth exposed card is suggestive of the outcome of the answer to said query.

19. The method of claim 18 further comprising dividing the deck of cards into three piles whereby each pile has a top card, and wherein said steps (d) and (e) comprise selecting said first card from the top of any of said three piles and placing said selected first card onto the first card receiving space on said surface and repeating the steps of selecting and placing the top card from any of said piles until said selected cards are placed onto each of the nine corresponding card receiving spaces on said surface.

20. The method of claim 19, wherein said indicia bearing faces of said first to ninth cards are exposed sequentially.

21. The method of claim 18, comprising shuffling and cutting the deck of cards.

22. The method of claim 18, wherein said indicia bearing faces of said first to ninth cards are exposed sequentially.

23. The method of claim 18, wherein said exposing step (f) comprises turning said cards over from right to left like turning pages of a book.

24. A method of playing a fortune telling card game using a deck of fortune telling cards comprising a plurality of cards, each of said cards having a top and bottom end and an indicia bearing face, the indicia of said indicia bearing face being oriented in a given direction from said top end to said bottom end, said indicia of each card comprising at least one word, symbol or combination thereof which bears a first suggestive relationship to a query when the card is oriented with the top end above the bottom end, and a second suggestive relationship to said query when said card is oriented with the top end below the bottom end; said plurality of cards comprising a first group of cards, each bearing indicia suggestive of at least one personal characteristic; and a second group of cards, each bearing indicia suggestive of a relationship to the query or a relationship to the indicia of each of said first group of cards or both, wherein the indica bearing face of each card of said deck or fortune telling cards faces away from and out of view of the player of the game during preparation of the deck of cards, the method comprising:

(a) posing a query;

(b) selecting two cards from said first group of cards of said deck of cards, said first card bearing a first suggestive relationship to an object of said query and said second card bearing a second suggestive relationship to an object of said query;

(c) placing said first and second cards in spaced-apart relationship from each other on a surface with the indicia bearing face of each card being exposed, wherein the space between said first and second card defines at least one unoccupied card receiving space;

(d) discarding a preselected number of cards from the top of said deck of cards, each card of said deck of cards having said indicia bearing face facing downward toward said surface to thereby reveal a top card of said deck of cards;

(e) removing the top card from said deck of cards after discarding a preselected number of cards and then placing said removed top card in an unoccupied card receiving space closest to said first card to form an occupied card receiving space;

(f) repeating steps (d) and (e) until each unoccupied card receiving space is converted to an occupied card receiving space containing a top card from said deck of cards;

(g) exposing the indicia bearing face of said top card in an occupied card receiving space;

(h) determining whether said exposed top card bears said first or said second suggestive relationship to said query; and (i) interpereting the relationship of each of said exposed top cards to said first and second card to thereby obtain an answer for said query.

25. The method of claim 24, wherein said preselected number in step (d) is six.

26. The method of claim 25, wherein the number of said unoccupied card receiving spaces is five.

27. The method of claim 26, wherein said exposing step (g) comprises turning said cards over from right to left like turning pages of a book.

28. The method of claim 24, wherein the number of said unoccupied card receiving spaces is five.

29. The method of claim 24, wherein said exposing step (g) comprises turning said cards over from right to left like turning pages of a book.

30. The method of claim 24, further comprising shuffling and then cutting said deck of cards after at least one of said step (a) and (b).

31. The method of claim 30, wherein said cutting step comprises cutting said deck of shuffled cards with the left hand.

* * * * *